United States Patent [19]

Beyl et al.

[11] Patent Number: 4,573,700

[45] Date of Patent: Mar. 4, 1986

[54] SKI BRAKE

[75] Inventors: Jean Beyl; Jean Bernard, both of Nevers; Daniel le Faou, Coulanges-les-Nevers; Henri Peyre, Nevers, all of France

[73] Assignee: STE Look, Nevers, France

[21] Appl. No.: 584,391

[22] Filed: Feb. 28, 1984

[30] Foreign Application Priority Data

Mar. 17, 1983 [FR] France ..... 83 04362

[51] Int. Cl.[4] ..... A63C 7/10

[52] U.S. Cl. ..... 280/605

[58] Field of Search ..... 280/605, 12 AB; 188/5, 188/7

[56] References Cited

U.S. PATENT DOCUMENTS

| | | | |
|---|---|---|---|
| 4,278,268 | 7/1981 | Szasz | 280/605 |
| 4,375,895 | 3/1983 | Szasz et al. | 280/605 |
| 4,383,700 | 5/1983 | Beyl | 280/605 |

FOREIGN PATENT DOCUMENTS

| | | | |
|---|---|---|---|
| 2612708 | 10/1976 | Fed. Rep. of Germany | 280/605 |

*Primary Examiner*—David M. Mitchell

*Attorney, Agent, or Firm*—Young & Thompson

[57] ABSTRACT

The braking arms of the ski brake are carried solely by an operating pedal which is pivoted to the ski about a transverse axis. The corresponding control ends of the braking arms are elbowed so as to form a V, the point of which is directed away from the braking shoes and/or away from the top face of the ski. The control ends are rotatably mounted within bores having the same angular orientation and formed in the operating pedal. By means of an elastic plug applied against a flat face formed in each control end, the braking arms are caused to rotate upon completion of an upward displacement and the active ends of the arms are automatically restored to their inwardly withdrawn position above the ski.

5 Claims, 14 Drawing Figures

SKI BRAKE

This invention relates to a ski brake of the type in which provision is made for two pivotal braking arms placed on each side of a ski equipped with a brake of this type. The so-called control ends opposite to the active ends of the braking arms carry an operating pedal which can be actuated by the ski boot.

In more precise terms, the invention relates to ski brakes of this type in which the arrangement is such that the active ends of the pivotal braking arms are inwardly withdrawn above the ski when they have been raised to their retracted position.

In the case of a large number of commercially available ski brakes, this design has already been adopted in order to prevent the active ends of the braking arms from projecting outward with respect to the edge faces of the ski.

There is thus described with reference to FIG. 7 of French Pat. No. 2,055,424 a ski brake in which the braking arms are drawn closer together in their upwardly retracted position as a result of a pivotal displacement about a longitudinal axis.

The amplitude of this movement of relative inward withdrawal is equal to the distance of outward displacement of the braking arms with respect to said longitudinal axis. The disadvantage of this solution, however, lies in the fact that it results in a considerable overall height of the braking system. It is in any case for this reason that a system of this type cannot be mounted in a central position of withdrawal beneath the ski boot.

Furthermore, in order to ensure retraction of the braking arms, it is necessary to provide movable operating members. This results in relative complexity of the braking system and in a high cost price.

French patent Application No. 2,447,208 also describes a ski brake in which the braking arms are inwardly withdrawn in the upwardly retracted position. This inward withdrawal is obtained by means of a pivotal movement of the braking arms so as to produce an upward displacement of their active ends to a position above the ski. Again in this instance, however, the same disadvantage of substantial overall height of the ski brake is encountered.

French patent Application Nos. 2,451,754 and 2,452,300 relate to ski brakes in which relative inward withdrawal of the braking shoes is obtained by means of a virtual movement of oscillation of the two corresponding arms in the transverse direction as a result of an angular displacement of these latter within bearings in which the elbowed portions of said arms are pivotally mounted and serve as pivot-pins. This movement of oscillation is accordingly controlled by the relative pivotal displacement which takes place between the operating pedal and the corresponding ends of the braking arms on completion of the upward movement of retraction of said arms.

With this objective, the ends of the braking arms are elbowed in such a manner as to have a particular orientation which determines the above-mentioned oscillating movement at the time of relative pivotal displacement of the operating pedal with respect to the braking arms.

This solution proves wholly satisfactory in practice. However, ski brakes of this type are relatively costly by reason of the fact that their braking arms must have multiple elbows corresponding to their different parts.

Furthermore, in order to move these braking arms from their raised position to their final position of inward withdrawal, it is necessary to exert a strong vertical force on the operating pedal by reason of the friction forces set up between the braking arms and their journal-bearings. This is also liable to hinder engagement of the boot in the ski binding under certain conditions such as, for example, in the case of a skier who has a light body weight or else when a skier is standing on powdery snow.

Since these friction forces also exist in the opposite direction, that is to say at the time of opening-out of the braking system in the active work position, it is necessary to provide a relatively powerful restoring spring. The existence of a spring of this type, however, is attended by a drawback: the ski brake applies against the ski boot an appreciable vertical thrust which may impair the effectiveness of the boot-restoring action produced by a resilient safety ski binding.

It is for these reasons that the aim of the present invention is to provide a ski brake of the same general type but so designed as to circumvent the disadvantages recalled in the foregoing. In consequence, the result achieved by the design concept of the invention is such that the ski brake is particularly simple and inexpensive to produce. This design concept also ensures that the upward movement of retraction of the ski brake can take place without calling for any considerable effort, with the result that it is possible to provide a restoring spring of limited power.

To this end, the braking arms of the ski brake in accordance with the invention are carried solely by the operating pedal which is pivoted to the ski about a transverse axis. The corresponding control ends of the braking arms are elbowed so as to form a V, the point of which is directed away from the braking shoes and/or away from the top face of the ski. Said control ends are rotatably mounted within bores having the same angular orientation and formed in the operating pedal. Means are provided for causing said control ends of the braking arms to rotate about their own axes within said bores after completion of the upward displacement of said braking arms in order to bring the active ends of said arms to their inwardly withdrawn position above the ski.

Thus the movement of relative inward withdrawal of the active ends of the braking arms is produced by a simple rotation of the opposite ends or so-called control ends of said arms within bores formed in the operating pedal. This movement of inward withdrawal is made possible by the elbowed shape of the braking-arm control ends and by the corresponding angular orientation of the bores which serve as bearings for said control ends.

Under these conditions, the movement of inward withdrawal and opening-out of the braking arms is not disturbed by any significant degree of rubbing friction which would call for the use of a sufficiently powerful restoring spring. It is therefore sufficient to provide a weak restoring spring which does not have the disadvantage of producing a substantial thrust on the ski boot when the ski brake is in the upwardly retracted position.

In a particular embodiment of the ski brake in accordance with the invention, the means provided for initiating a movement of rotation of the control ends of the braking arms about their own axes in the position of relative inward withdrawal of said arms consist of resilient members which have a continuous tendency to initiate said movement of rotation. However, this movement is prevented from taking place as long as the braking arms have not been lifted above the top surface of the ski.

In another embodiment, the movement of rotation of the braking arms as they return to their inwardly withdrawn position is initiated by a stop located above the raised position of the active ends of said arms. Thus the stop prevents said active ends from continuing their upward movement of retraction at the time of downward positioning of the operating pedal against the ski. The control ends of the braking arms are thus caused to rotate about their own axes within the bores provided within said operating pedal. If so required, the stop thus provided can be constituted by another equipment element of the corresponding ski such as, for example, the rotatable plate of the pivotal heel-retaining unit of a ski binding.

Other features of the invention will be more apparent upon consideration of the following description and accompanying drawings, wherein.

Figure 1:
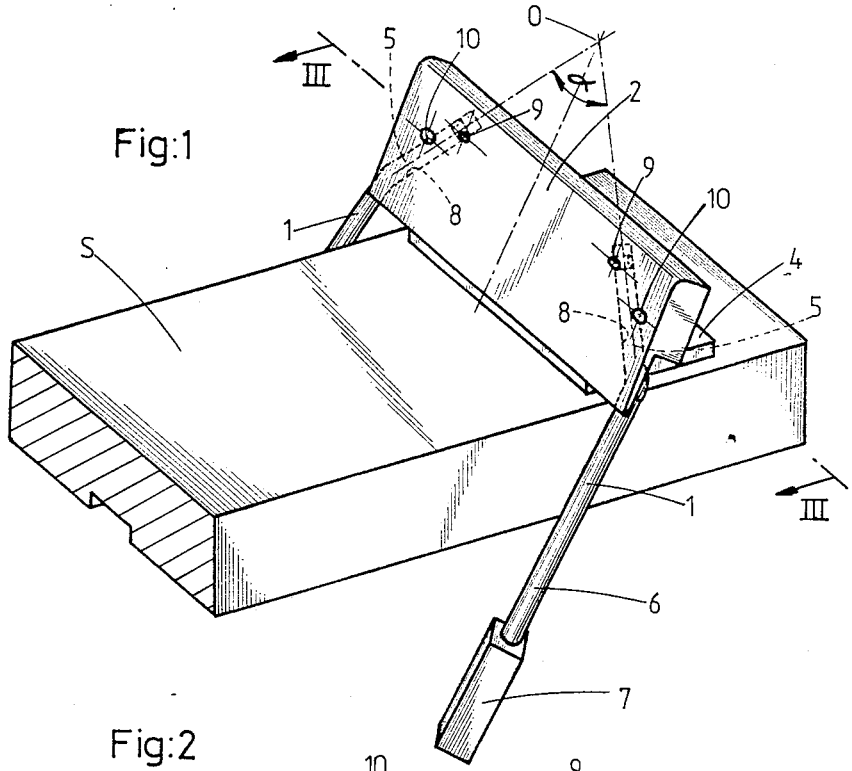
FIG. 1 is a view in perspective which illustrates a first embodiment of a ski brake unit in accordance with the invention, this unit being shown in the active braking position.
Figure 2:
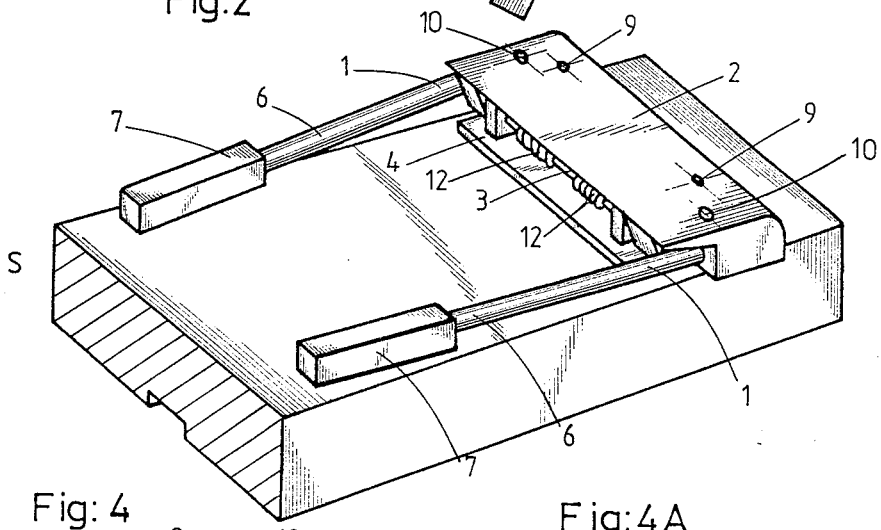
FIG. 2 is a view in perspective which illustrates the same unit in the raised and inwardly withdrawn position of its braking arms.

The ski brake illustrated in FIGS. 1 to 7 comprises two pivotal arms 1 of rigid wire which are intended to be placed on each side of the corresponding ski S. In contrast to the majority of ski brakes of this type, these two arms are not pivotally mounted directly on the ski. They are in fact carried solely by an operating pedal 2 which is intended to be actuated by the corresponding ski boot. This pedal is pivoted about a cross-pin 3 which extends in the transverse direction above the ski and parallel to the top surface of this latter, said cross-pin being carried by a bearing plate 4 which is fixed on the top face of the ski.

The two braking arms 1 are mounted on the operating pedal 2 by means of one of their ends, namely the so-called control end 5 which is opposite to the active end 6, a braking shoe 7 being fitted on said active end.

The control ends 5 of the two braking arms 1 are inclined toward each other by means of an elbow and are mounted so as to be capable of rotating about their own axes within bores 8 formed within the thickness of the operating pedal 2 and having the same angular orientation. These control ends are held in position by a locking pin 9 or any other suitable member which permits rotation of said ends about their own axes.

Figure 7:
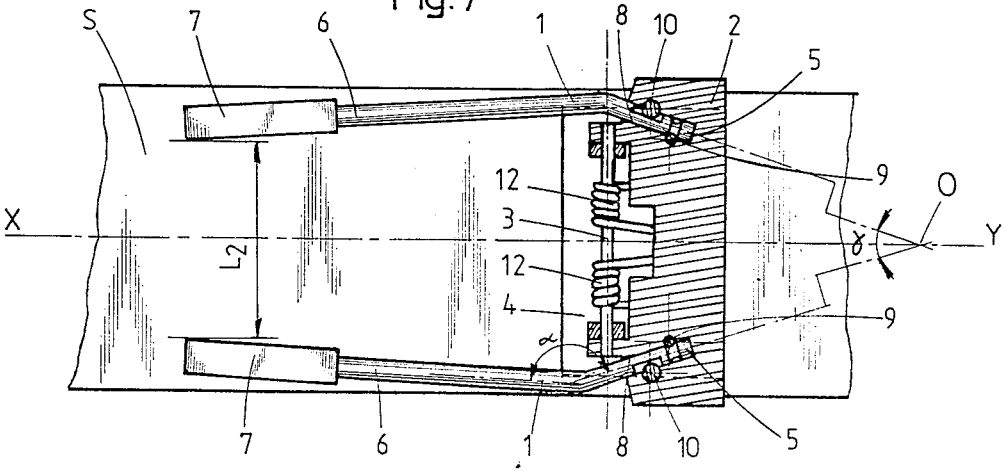
FIG. 7 is a sectional view taken along line VII—VII of FIG. 6.

The plane formed by the elbowed control ends 5 of the two braking arms is parallel to the top and bottom faces of the pedal 2. Taking into account the fact that they are inclined with respect to each other, the elbowed control ends 5 of the two braking arms 1 form a V, the apex O of which is directed away from the active ends 6 of these two arms (as shown in FIG. 7). It will be understood that this apex is also located in the plane at right angles to the ski which passes through the central longitudinal axis X-Y of the ski.

It is worthy of note that the elbow angle $\alpha$ of the braking arms and the angular orientation of the bores 8 formed within the thickness of the pedal 2 are such that the relative spacing of the ends of the braking shoes can be modified simply by rotating the arms 1 about the axes of their control ends within the bores 8, between a maximum relative spacing L1 corresponding to the work position of these two arms and a position of minimum relative spacing L2 corresponding to the raised position of these latter above the ski when the brake is in readiness for operation. This minimum spacing L2 is such that the braking arms, and especially their active braking ends 6, are in the inwardly withdrawn position with respect to the side edges of the ski in such a manner as to ensure that they do not project outward with respect to these edges (as shown in FIG. 7).

Figure 4:
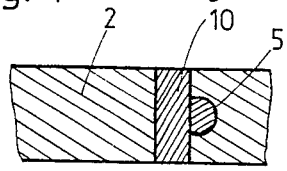
FIG. 4 is a sectional view of a detail taken along line IV—IV of FIG. 3 but to a different scale and illustrating the resilient member which tends to restore the corresponding braking arm to its inwardly withdrawn position.
Figure 4A:
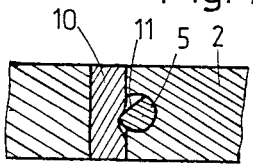
FIG. 4A is a similar view illustrating the same braking arm prior to rotation of the control end of the arm about its own axis in the inwardly withdrawn position of said arm.

In the example illustrated in FIGS. 1 to 7, provision is made for resilient restoring members which tend to cause the elbowed control ends 5 of the braking arms to rotate about their own axes within the bores 8 in a position corresponding to the minimum relative spacing L2 of the active ends of said braking arms. These resilient members can consist of cylindrical rubber plugs 10 which are fitted within the thickness of the pedal 2 and each produce action on a flat face 11 formed on the elbowed control end 5 of the corresponding braking arm. The angular orientation of said flat face is such that this latter is located tangentially to a generator-line of the corresponding resilient plug 10 when the respective braking arm 1 is in its position of inward withdrawal (as shown in FIG. 4). When said arm is moved away from this position, the flat face 11 can take up the position shown in FIG. 4*a*. In this case the elasticity of the resilient plug tends to restore the corresponding arm to its inwardly withdrawn position.

Figure 3:
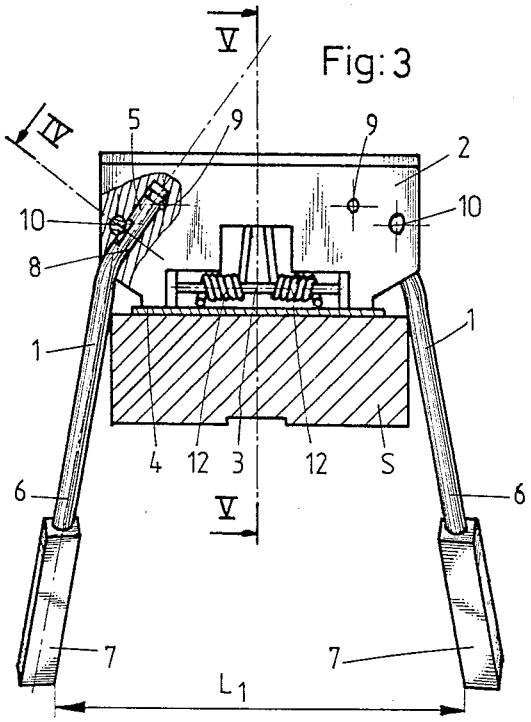
FIG. 3 is a part-sectional view of said first embodiment, this view being taken along line III—III of FIG. 1.
Figure 5:
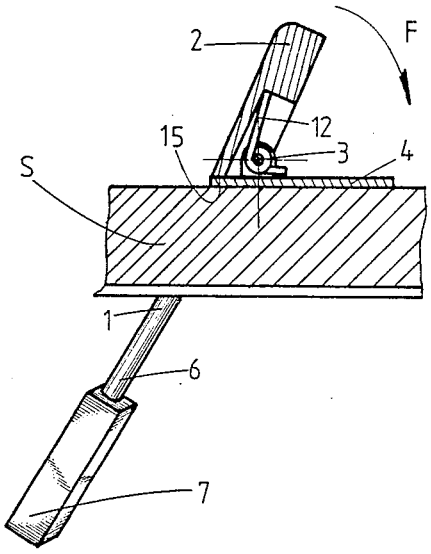
FIG. 5 is a sectional view taken along line V—V of FIG. 3.
Figure 6:
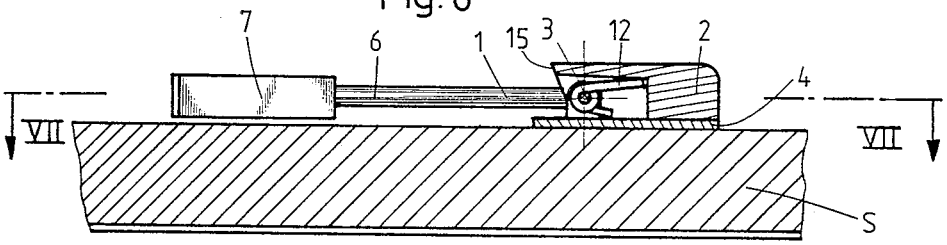
FIG. 6 is a similar view which illustrates the same ski brake in the raised and inwardly withdrawn position of its braking arms.

Furthermore, another restoring spring is provided for lifting the operating pedal 2 to the position shown in FIGS. 1, 3 and 5. This spring can consist of a torsion spring 12 placed around the pivot-pin 3 of said pedal.

In the raised position of the operating pedal 2 of the ski brake under consideration, the two braking arms 1 are directed downwards as illustrated in FIGS. 1, 3 and 5. Under these conditions, the braking arms and their active ends 6 penetrate into the snow in order to produce the desired braking action. In this position, the edge faces of the ski prevent relative inward withdrawal of the active ends 6 of the braking arms under the action of the resilient restoring members consisting of the cylindrical plugs 10.

It should be pointed out that the pivotal displacement of the operating pedal 2 in its raised position is limited by the abutting application of the edge face 15 of said pedal against the bearing plate 4. To this end, said edge face is beveled at a predetermined angle in order to ensure that the operating pedal 2 is accordingly in the oblique position shown in FIG. 5.

When the skier places his ski boot on the operating pedal 2 with a view to mounting this latter in the corresponding ski binding, this has the effect of initiating a pivotal displacement of said operating pedal in the direction F about its pivot-pin 3 in opposition to the action of the spring 12. The operating pedal is then accompanied in its movement by the braking arms 1 and lifts the active ends 6 of these two braking arms to their retracted position above the top surface of the ski.

However, as long as the braking shoes 7 have not reached the level of the top ski face, the side faces of the ski prevent any movement of relative inward withdrawal of said braking shoes.

But as soon as these braking shoes have been raised to a sufficient extent, the resilient plugs 10 produce a movement of rotation of the braking arms 1 about their own axes until they reach their inwardly withdrawn position shown in FIG. 7.

Conversely, as soon as the ski boot is lifted from the operating pedal 2, the spring 12 produces an upward displacement of said pedal and the braking shoes 7 are thus applied against the ski. This in turn produces a movement of rotation of the braking arms about the axes of the control ends within the bearings 8 provided in the pedal 2 until the relative spacing of the braking shoes is sufficient to enable the braking arms to pass on each side of the edges of the ski. Thus the braking shoes 7 will automatically be moved to their position of maximum spacing L1 which is their active work position.

It can be observed that the movements of opening-out and relative inward withdrawal of the braking arms result from the elbowed shape of their control ends 5 and from the angular orientation of the bores 8 formed within the operating pedal 2 in order to serve as journal-bearings for the corresponding control ends of the two arms. In actual practice, these movements take place without any significant friction caused by rubbing of the braking arms against the ski or against ancillary parts fixed on this latter. In consequence, it is only necessary to provide a relatively weak restoring spring 12 for the purpose of controlling the displacement of these arms to their active work position. Thus, in the standby position, the ski boot is not subjected to a large vertical thrust force which would be liable to interfere with the engagement of the safety ski binding for retaining the boot on the ski.

Another important advantage of the ski brake under consideration lies in its extremely simple constructional design. Thus the braking arms do not have a series of successive elbows as is the case in some devices of the prior art. Furthermore, these arms are carried solely by the operating pedal which is pivotally mounted directly on the ski. The resulting simplification of the ski-brake structure has the advantage of producing an appreciable reduction in the cost price of this system.

A further advantage of the ski brake in accordance with the invention is its extremely small overall height. There is consequently no difficulty in placing the brake unit beneath the position of the central portion of the corresponding ski boot.

Figure 8:
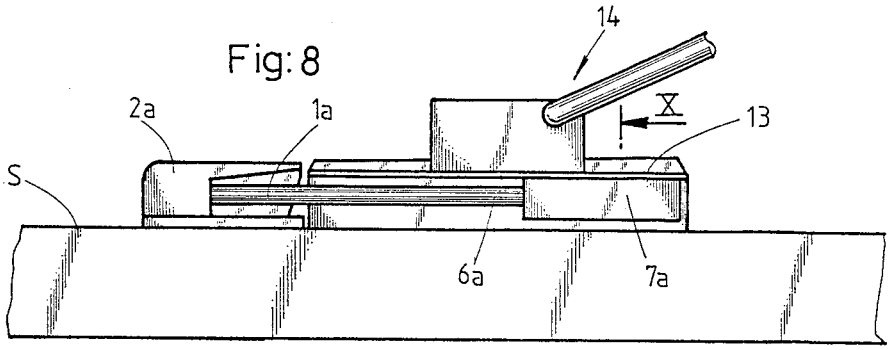
FIG. 8 is a view in side elevation illustrating an alternative embodiment of the ski brake as shown in the raised and inwardly withdrawn position of its braking arms.
Figure 9:
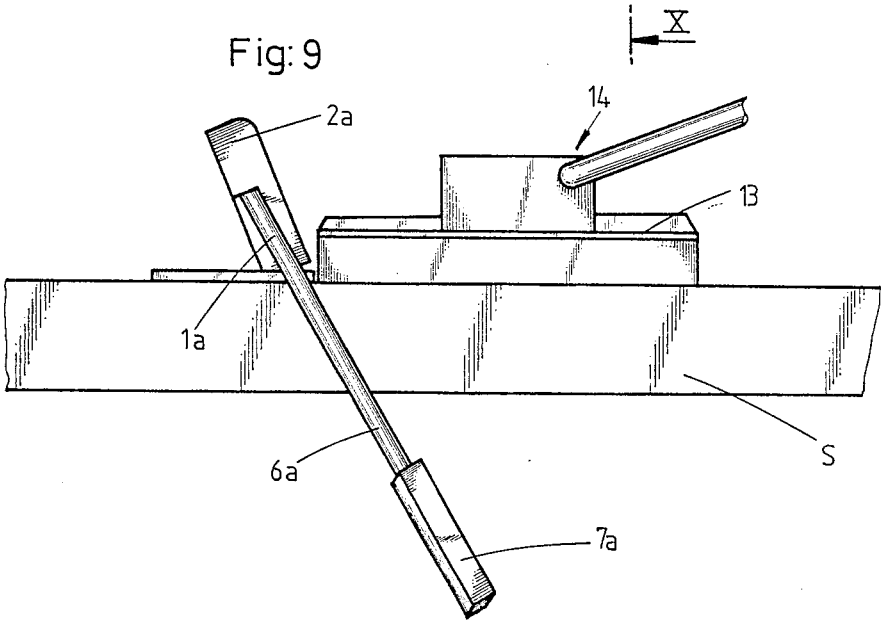
FIG. 9 is a similar view illustrating the same ski brake in the position of opening-out of its braking arms.
Figure 10:
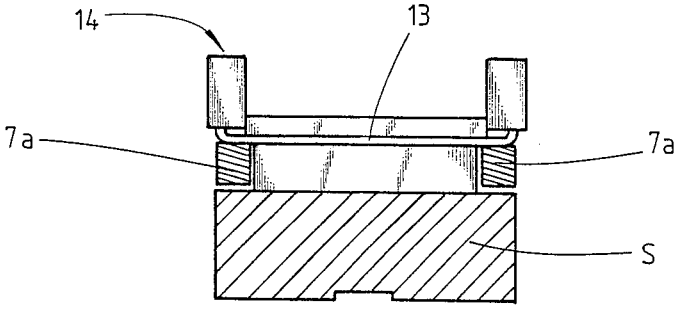
FIG. 10 is a transverse sectional view taken along line X—X of FIG. 8.

FIGS. 8 to 10 illustrate a variant of the embodiment described in the foregoing. This alternative form of construction differs from the previous embodiment solely in the fact that the resilient members for restoring the braking arms to their inwardly withdrawn position are dispensed with and that the corresponding movement is controlled in this case by a stop located above the raised position of the braking shoes. As contemplated by the example illustrated in the figures, this stop can advantageously be constituted by another equipment element of the corresponding ski, namely the rotatable plate 13 of a heel-retaining unit 14.

With the exception of this modification, the entire structure of the corresponding brake unit is the same as before. It is for this reason that the different brake components are represented by the same reference numerals to which is simply added the index a.

In this alternative embodiment, at the time of downward positioning of the operating pedal **2*a* against the ski, the braking shoes 7*a* are abuttingly applied against the rotatable plate 13*b*. This accordingly has the effect of stopping the upward displacement of the shoes in this position whereas the operating pedal 2*a*** has not yet been completely folded-back against the ski.

In consequence, the continued downward displacement of the operating pedal produces a rotation of the corresponding elbowed control ends of the braking arms **1*a* up to the position in which the shoes 7*a* of the braking arms are brought into the inwardly withdrawn position with respect to the edges of the ski (as shown in FIG. 10**).

Figure 11:
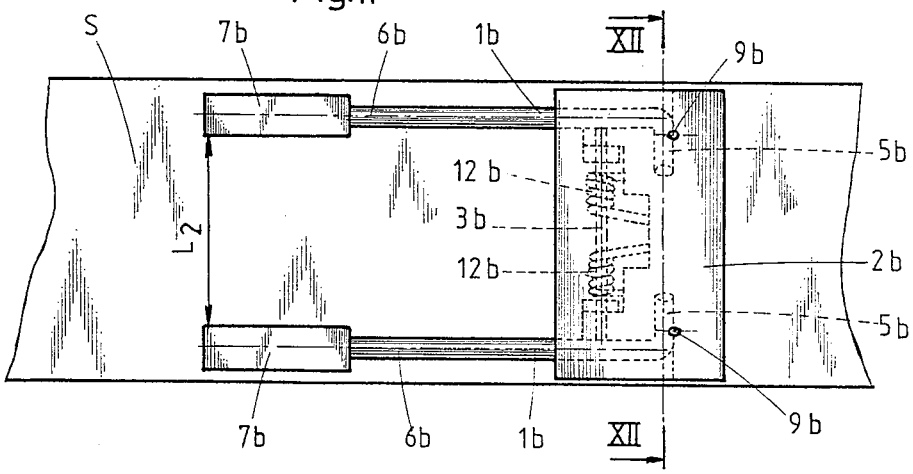
FIG. 11 is an overhead plan view of another embodiment of the ski brake in accordance with the invention.
Figure 12:
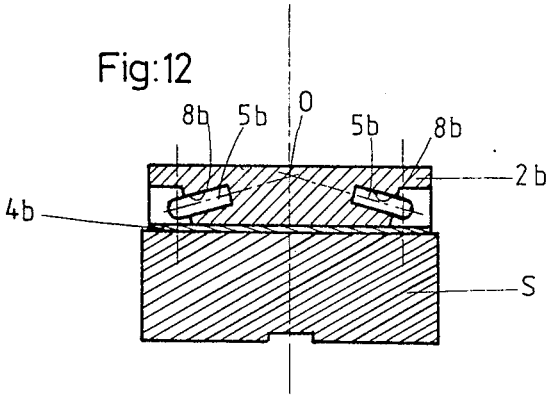
FIG. 12 is a transverse sectional view taken along line XII—XII of FIG. 11.
Figure 13:
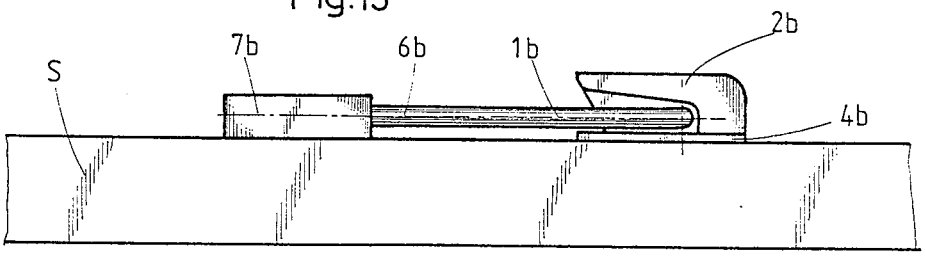
FIG. 13 is a view in side elevation of said second embodiment, the braking arms being shown in the raised position.

FIGS. 11 to 13 illustrate another embodiment of the ski brake in accordance with the invention. This embodiment differs from that shown in FIGS. 1 to 7 in respect of a different orientation of the bores which are formed within the thickness of the operating pedal and which serve as journal-bearings for the corresponding elbowed control ends of the braking arms.

The general structure of this ski brake, however, is the same as before. Under these conditions, its different components are designated by the same reference numerals followed simply by the index b.

In this particular form of construction, the plane formed by the elbowed control ends **5*b* of the braking arms 1*b* is perpendicular to the top and bottom faces of the operating pedal 2*b*. Furthermore, the apex O of the V formed by the axes of these two control ends is now directed upwards and no longer in a direction away from the braking shoes (see FIG. 12**).

However, the arrangement is such that, in the raised position of the braking arms **1*b* corresponding to downward positioning of the operating pedal 2*b* against the ski, the braking shoes 7*b* have their minimum spacing, with the result that they are fully withdrawn with respect to the edges of the ski (as shown in FIG. 11). But by virtue of the angular orientation of the bores 8*b* formed within the thickness of the pedal 2*b* and also by virtue of the elbows of the braking arms 1*b***, the upward displacement of the operating pedal is accompanied by a relative outward displacement of the braking shoes *7b* on each side of the ski as a result of rotation of the control ends of said arms within the corresponding bores.

In this form of construction, the return of the braking arms to their position of inward withdrawal shown in FIG. 11 can be carried out either by means of resilient members such as the cylindrical plugs 10 provided in the embodiment of FIGS. 1 to 7 or by means of a stop for limiting the upward displacement of the braking shoes as proposed in the embodiment shown in FIGS. 8 to 10.

However, the ski brake in accordance with the invention is not limited to the examples which have been described in the foregoing and which have been given solely by way of indication. Thus the plane formed by the elbowed control ends of the braking arms could be inclined with respect to the top and bottom faces of the operating pedal instead of being parallel or perpendicular to this latter. In this case the apex of the V of said control ends would be oriented both in the direction away from the braking shoes and in the upward direction, that is to say away from the top face of the ski.

Moreover, instead of providing elastic restoring members or a stop for producing a movement of relative inward withdrawal of the braking arms 6, it is possible to dispense with these means by allowing the ski boot to perform the function of a stop which initiates this movement. Thus, when the ski boot is placed on the ski, the boot is applied first against the operating pedal and produces an upward movement of retraction of the braking shoes. Then, at the end of this upward movement, the braking shoes are abuttingly applied against the ski boot which is practically in a flat position on the ski. This has the effect of inwardly withdrawing the braking shoes above the ski. Thus the ski boot performs the same abutment or stop function as the rotatable plate 13 of the heel-retaining unit 14 shown in FIGS. 8 to 10.

What is claimed is:

1. A ski brake comprising two movable braking arms which are intended to be placed on each side of a ski and the active ends of which are inwardly withdrawn above the ski in their raised position whilst the opposite control ends of said braking arms are associated by means of an operating pedal which can be actuated by the corresponding ski boot, wherein the braking arms are carried solely by the operating pedal which is pivotally mounted on the ski and capable of pivotal displacement about a transverse axis, the corresponding control ends of said arms being elbowed in order to form a V whose point is directed away from the active ends of said arms and/or away from the ski, said control ends being rotatably mounted within bores having the same angular orientation and formed in the operating pedal, means being provided for causing said control ends of the braking arms to rotate about their own axes within said bores after completion of the upward displacement of said braking arms in order to bring the active ends of said arms to their inwardly withdrawn position above the ski in the standby position of said ski brake.

2. A ski brake according to claim 1, wherein the means for causing movement of rotation of the braking arms in the position of relative inward withdrawal of said arms comprise resilient restoring members for producing continuous action on the elbowed control ends of said arms which are nevertheless prevented from rotating by edge faces of the ski as long as they are not upwardly displaced to their standby position.

3. A ski brake according to claim 2, wherein the resilient members which tend to cause rotation of the braking arms comprises elastic plugs each placed opposite to a flat face formed on the elbowed control end of the corresponding braking arm, the angular orientation of the flat face being such that said face is parallel or tangent to the respective elastic plug when the corresponding braking arm is in its inwardly withdrawn standby position.

4. A ski brake according to claim 1, wherein the means for causing rotational displacement of the braking arms to their inwardly withdrawn position comprises a stop placed above the raised position of the active ends of said arms, said active ends being abuttingly applied against said stop before the operating pedal has completely folded-back against the ski.

5. A ski brake according to claim 4, wherein the stop placed above the raised position of the active ends of the braking arms is constituted by another equipment element of the corresponding ski.

* * * * *